United States Patent [19]

Shu

[11] 4,410,042

[45] Oct. 18, 1983

[54] IN-SITU COMBUSTION METHOD FOR RECOVERY OF HEAVY OIL UTILIZING OXYGEN AND CARBON DIOXIDE AS INITIAL OXIDANT

[75] Inventor: Winston R. Shu, Dallas, Tex.

[73] Assignee: Mobil Oil Corporation, New York, N.Y.

[21] Appl. No.: 317,034

[22] Filed: Nov. 2, 1981

[51] Int. Cl.[3] ..... F21B 43/243

[52] U.S. Cl. ..... 166/261

[58] Field of Search ..... 166/256, 261, 272, 274

[56] References Cited

U.S. PATENT DOCUMENTS

| | | | |
|---|---|---|---|
| 2,818,117 | 12/1957 | Koch | 166/256 |
| 3,034,579 | 5/1962 | Parker | 166/256 X |
| 4,042,026 | 8/1977 | Pusch et al. | 166/261 X |
| 4,158,467 | 6/1979 | Larson et al. | 166/261 X |
| 4,353,413 | 10/1982 | Hoekstra et al. | 166/261 X |

*Primary Examiner*—Stephen J. Novosad
*Assistant Examiner*—George A. Suchfield
*Attorney, Agent, or Firm*—Alexander J. McKillop; James F. Powers, Jr.; Lawrence O. Miller

[57] ABSTRACT

An in-situ combustion method for recovering viscous oil from a subterranean, viscous oil-containing formation comprising injecting a mixture of essentially pure oxygen and carbon dioxide into the formation to initiate an in-situ combustion operation followed by injecting essentially pure oxygen.

5 Claims, No Drawings

IN-SITU COMBUSTION METHOD FOR RECOVERY OF HEAVY OIL UTILIZING OXYGEN AND CARBON DIOXIDE AS INITIAL OXIDANT

BACKGROUND OF THE INVENTION

1. Field of the Invention

This invention pertains to the recovery of oil from a subterranean, viscous oil-containing formation utilizing an improved in-situ combustion process.

2. Background of the Invention

In-situ combustion is a common method for recovering viscous crudes or tar sands. The use of high purity oxygen in place of air significantly improves the performance of the in-situ combustion process. The injection of oxygen into a wellbore, however, presents significant hazards and requires safety precautions. Previous work in this regard includes the injection of $O_2$ through a bottom water zone, as disclosed in U.S. Pat. No. 3,208,519, and the initiation of combustion with air followed by oxygen as disclosed in an article by G. Pusch, Erdol und Kohle-Erdgas-Petrochemie combined with Brennstoff-Chemie, Vol. 30, No. 1, Jan. 1977, pp. 13–25. All these methods use air to establish gas flow. However, it has been found that injection of air increases the viscosity of the oil by 100 times when the oil is contacted by air for two days at 210° F. This increase in viscosity is detrimental to the recovery process. In addition, the inert gaseous nitrogen in the air injected tends to reduce the effective permeability for oil in the reservoir.

My invention proposes a method to initiate the in-situ combustion operation initially using a combustion supporting gas comprising a mixture of essentially pure oxygen and carbon dioxide followed by the use of essentially pure oxygen that eliminates the problem of increasing the viscosity of the oil in the formation using conventional combustion supporting gases such as air, air enriched with oxygen, or oxygen.

SUMMARY OF THE INVENTION

The invention is a method for recovering oil from a subterranean, viscous oil-containing formation penetrated by at least one injection well and a spaced apart production well comprising initiating in-situ combustion by injecting a mixture of essentially pure oxygen and carbon dioxide into the injection well followed by injecting essentially pure oxygen into the formation to support in-situ combustion either immediately after the initiation of combustion or after the combustion front has advanced away from the injection well a distance of at least 30 feet. The amount of carbon dioxide mixed with oxygen for initiation of in-situ combustion is not more than 80%. The use of an oxygen/carbon dioxide mixture to initiate in-situ combustion does not promote degradation in oil viscosity due to oxidation.

DESCRIPTION OF THE PREFERRED EMBODIMENT

In one embodiment of my invention, an in-situ combustion front is established in a subterranean, viscous oil-containing formation such as tar sand deposits by injecting a combustion-supporting gas comprising essentially pure oxygen and carbon dioxide. The oxygen/carbon dioxide mixture is introduced into the formation via at least one injection well to establish an in-situ combustion front and oil is produced from the formation via a spaced apart production well. The amount of carbon dioxide mixed with the oxygen must not be more than 80% so as not to interfere with the in-situ combustion process. The amount of carbon dioxide may be substantially less than 80%, depending upon the experience of operating personnel in handling high purity oxygen. Once an in-situ combustion front is initiated, or preferably after the combustion front has advanced away from the injection well a distance of at least 30 feet, the mixture of $O_2/CO_2$ is terminated and essentially pure oxygen is injected into the injection well to support combustion. In a preferred embodiment, after in-situ combustion has been initiated, or preferably after the combustion front has advanced away from the injection well a distance of at least 30 feet, the amount of carbon dioxide injected into the formation along with oxygen is gradually decreased at a controlled rate until the combustion-supporting gas comprises essentially pure oxygen.

The use of a mixture of oxygen and carbon dioxide as the combustion-supporting gas to initiate in-situ combustion does not promote degradation in oil viscosity due to oxidation as is the case with mixtures of oxygen and nitrogen in conventional in-situ combustion processes. In the present process, any increase in oil viscosity due to oxidation is more than offset by a reduction in viscosity due to carbon dioxide dissolution. For example, an Athabasca bitumen with a viscosity of 50,000 cp at 104° F. will have a reduction in viscosity by 100 times, when saturated with carbon dioxide at 600 psia (see Jacobs, F. A., et al., J. Can. Pet. Tech., Oct.–Dec., 1980, pages 46–50). In the latter example, it is disclosed that it requires only 200 scf of carbon dioxide to saturate a barrel of oil at 600 psia. Assuming the oil saturation is 1000 bbls/ac-ft, it requires only $0.2\times10^6$ scf/ac-ft of carbon dioxide to saturate the oil. After in-situ combustion has been initiated, there is a sufficient amount of carbon dioxide generated in-situ to saturate the oil in the formation so there is no need to continuously inject carbon dioxide during the combustion process. It is noted that the dissolution of the carbon dioxide in the oil reduces the free gas in the reservoir and increases effective oil permeability. In addition, carbon dioxide has a nice fire-extinguishing characteristic which can be conveniently applied in the case of an accidental wellbore ignition.

The oxygen and carbon dioxide may both be stored in liquid form near the injection well or wells. Both materials may be more conveniently pumped in liquid form from separate storage tanks into a vaporizer and then injected into the injection well. The composition of the oxygen/carbon dioxide mixture supplied to the injection well is controlled by sensing and controlling the flow rates of the individual oxygen and carbon dioxide streams by means of a flow controller.

What is claimed is:

1. A method for recovering oil from a subterranean, viscous oil-containing formation penetrated by at least one injection well and a spaced apart production well comprising:

(a) initiating an in-situ combustion front in the formation by injecting a combustion-supporting gas comprising a mixture of essentially pure oxygen and carbon dioxide into the injection well and continuing injection of said combustion-supporting gas until said combustion front has advanced a predetermined distance from the injection well, said injected carbon dioxide dissolving in the in place oil thereby reducing its viscosity and increasing effective oil permeability;

(b) thereafter terminating injection of the mixture of essentially pure oxygen and carbon dioxide and injecting essentially pure oxygen into the injection well to support in-situ combustion; and (c) producing oil from the formation via said production well.

2. The method of claim 1 wherein the combustion-supporting gas in step (a) comprises not more than 80% carbon dioxide.

3. The method of claim 1 wherein injection of the mixture of essentially pure oxygen and carbon dioxide is continued during step (a) until the combustion front has advanced away from the injection well a distance of at least 30 feet.

4. The method of claim 1 further comprising gradually decreasing the amount of carbon dioxide in said combustion-supporting gas following step (a) until the gas injected comprises essentially pure oxygen.

5. The method of claim 4 wherein the amount of carbon dioxide is gradually decreased when the combustion front has advanced away from the injection well a distance of at least 30 feet.

* * * * *